United States Patent [19]

Stuart-Bruges

[11] Patent Number: 4,852,070

[45] Date of Patent: Jul. 25, 1989

[54] METHOD AND APPARATUS FOR TRANSMITTING AND PROCESSING DATA FROM WELL LOGGING TOOL

[75] Inventor: William P. Stuart-Bruges, Cholderton, Nr. Salisbury, United Kingdom

[73] Assignee: Halliburton Logging Services, Inc., Houston, Tex.

[21] Appl. No.: 57,509

[22] Filed: Jun. 3, 1987

[30] Foreign Application Priority Data

Jun. 19, 1986 [GB] United Kingdom ..... 8614971

[51] Int. Cl.[4] ..... H04H 9/00

[52] U.S. Cl. ..... 367/81; 367/25

[58] Field of Search ..... 340/853, 854, 860; 377/64, 66, 70, 72, 76, 80; 367/81, 25, 35; 342/161, 184

[56] References Cited

U.S. PATENT DOCUMENTS

| | | | |
|---|---|---|---|
| 3,792,430 | 2/1974 | Niven, Jr. | 340/860 |
| 3,953,838 | 4/1976 | Gilberg et al. | 377/66 X |
| 4,040,002 | 8/1977 | Durand | 340/860 |
| 4,047,430 | 9/1977 | Angehrn | 340/860 X |
| 4,156,288 | 5/1979 | Spandorfer | 377/70 X |
| 4,545,242 | 10/1985 | Chan | 340/853 X |
| 4,556,884 | 12/1985 | Howells et al. | 340/860 |
| 4,649,512 | 3/1987 | Nukiyama | 377/66 X |
| 4,672,646 | 6/1987 | Van Maren | 377/70 |
| 4,684,947 | 8/1987 | Zimmer | 340/853 X |

*Primary Examiner*—Thomas H. Tarcza
*Assistant Examiner*—Tod Swann
*Attorney, Agent, or Firm*—William J. Beard

[57] ABSTRACT

A method and apparatus is disclosed for avoiding problems caused by a logging tool sticking in a borehole and subsequently accelerating when it becomes free. Such problems give rise to measurement errors and loss of data, particularly when the tool is in the vicinity of ground discontinuities where the data is especially valuable. In accordance with the method and apparatus, data is stored in the tool as it is moved within the borehole, the data being stored in a manner which varies in accordance with any difference between the actual motion of the tool in the borehole and the apparent motion of the tool as measured at the surface. The stored data is transmitted from the tool to the surface at a rate within a transmission bandwidth capacity of a communication link. According to one arrangement, means are provided for shifting the writing position of data entered into a memory, the shifting means being responsive to an error signal related to any difference between the actual and apparent motions of the tool. The memory may also be operated in a FIFO mode.

8 Claims, 2 Drawing Sheets

METHOD AND APPARATUS FOR TRANSMITTING AND PROCESSING DATA FROM WELL LOGGING TOOL

Figure 1:
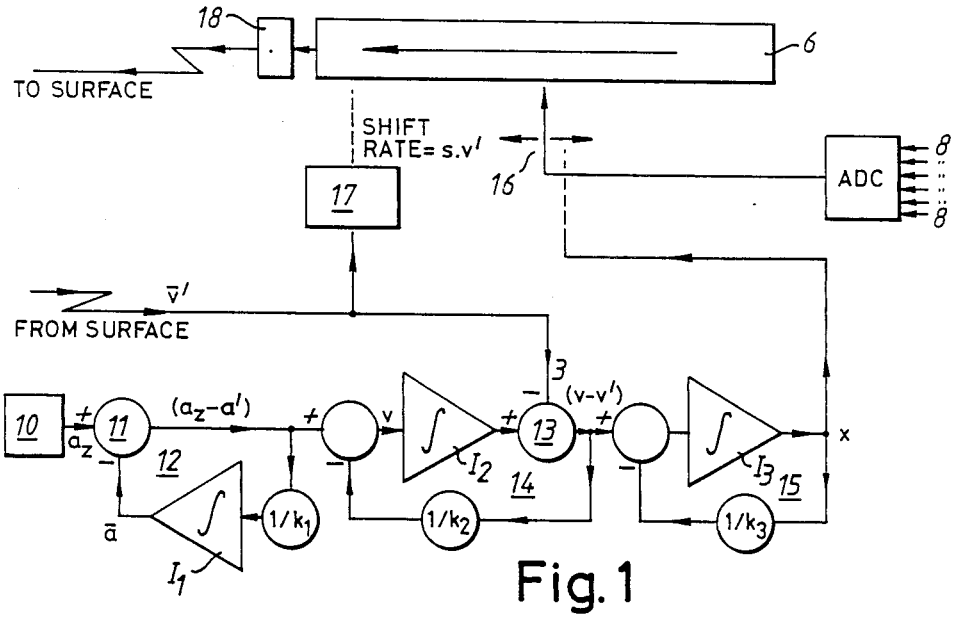

This invention relates to a method and apparatus for transmitting and processing data from a well-logging tool. The invention may be applied to avoid problems caused by a logging tool sticking in a borehole and subsequently accelerating when it becomes free. Such problems can give rise to measurement errors and loss of data, particularly when the tool is in the vicinity of ground discontinuities where the data is especially valuable.

In the well-logging field, the electronic circuitry of a well-logging tool is usually connected to a computer at the surface by means of a data telemetry cable. However the data transmission rate of such a cable is limited due to its restricted bandwidth. This can cause problems when data needs to be transmitted from the logging tool to the computer at a high transmission rate.

Modern logging tools contain a variety and multiplicity of sensors which all contribute to the amount of data which is collected for transmission to the computer. Such tools are already working near the limits of the data transmission rates of telemetry cables and if these transmission rates are exceeded, data can be lost and hence logging errors can be caused. Under normal circumstances, the logging tool is withdrawn from a borehole at a constant speed, the speed being measured with respect to the rate of rotation of a measuring wheel fitted to a surface winch. If the logging tool sticks in the bore-hole, particularly when it is at a low depth, the long length of cable, which extends between the tool and the winch, can stretch by as much as 20 meters before the tool becomes free and once again moves upwardly towards the surface. The energy stored in the stretched cable will cause the tool to accelerate when it becomes free, and to travel at up to twice or three times its normal speed for a short period. As data is recorded, at the surface, with respect to tool depth, and as tool depth is measured primarily with respect to winch movement, the data which is recorded when the tool has become jammed in the borehole is incorrect with respect to depth measurement. Moreover, when the tool comes free, the data is effectively compressed at the surface, due to the excessive speed of the tool, and some of the data may be lost due to the inadequate sampling rate. As the tool is most likely to become jammed where there are discontinuities in the ground formations surrounding the borehole, particularly valuable data can be lost and logging errors at these discontinuities will give false information concerning the content and shape of the geological strata.

The above problem has been widely experienced in the art over a long period of time. One technique for alleviating this problem is to install an accelerometer on board the logging tool which transmits data to the computer relating to the temporal transients in the motion tool. Whilst this technique enables the motion of the tool to be more accurately logged, data can still be lost when the tool is travelling faster than its normal speed. For example, if the tool were travelling at two to three times its normal speed, the bandwidth of the cable may limit the definition of the data transmitted. In particular the tool will not send enough samples, per unit of time, to provide a complete log since the sampling rate, which is normally fixed at or near the limit of the cable's information capacity, may be too slow to capture the fast moving events.

The present invention seeks to overcome these problems by providing a method of processing and transmitting well-logging data, wherein a well-logging tool is moved in a borehole in order to collect data relating to ground formations, the data being transmitted to a surface station by means of a communication link, and the method being characterised by:

(a) storing said data in said tool as it is moved within the borehole, said data being stored in a manner which varies in accordance with any difference between the actual motion of the tool in the borehole and the apparent motion of the tool as measured at the surface, and (b) transmitting the stored data from said tool to the surface at a rate within the transmission bandwidth capacity of said communication link.

According to one embodiment of the invention, the step of storing the data in the tool is performed by shifting the position at which the data is written in a memory, the rate of shift depending on the difference between the actual and apparent motions of the tool in the borehole.

In accordance with another embodiment of the invention the data storing step is performed by clocking the data into a memory operating in a feed-in-feed-out mode, the data being clocked in at a rate which depends on the difference between the actual and apparent motions of the tool in the borehole.

The actual motion of the tool in the borehole can be determined by different means. For example, an accelerometer or other motion sensitive device can be fitted on-board the tool in order to provide the motion-related signal. In the case of an accelerometer, its output can be integrated to provide a velocity term, and further integrated to provide a displacement term.

Alternatively, the tool may be provided with at least a pair of electrodes which are spaced apart with respect to the longitudinal axis of the tool so that the data, which is derived successively from each electrode as the tool moves towards the surface, can be used to provide the motion-related signal.

Conventional means, such as a winch fitted with a device for measuring the amount of cable paid-out, can be used to provide the signal which relates to the apparent motion of the tool. Such means may provide a depth signal which can be differentiated with respect to time to provide a velocity term.

In the preferred arrangements, an error signal is derived which is proportional to the difference between the actual and apparent velocities of the tool. However, other arrangements are possible where, for example, the measured depth of the tool, time and a signal generated on-board the tool are taken into account (e.g. motion can be derived from depth,velocity or accelerational measurements).

The invention also provides apparatus for processing and transmitting well-logging data, the apparatus comprising a well-logging tool fitted with sensors for collecting data relating to ground formations adjacent a borehole, means for suspending the tool within the borehole and for providing a first signal which relates to the apparent motion of the tool in the borehole, a communication link for transmitting said data to a surface station, and means on-board the tool for providing a second signal which relates to the motion of the tool within the borehole, the apparatus being characterised in that the tool is provided with:

(a) on-board memory means for storing data derived from said sensors;

(b) means responsive to the first and second signals for providing an error signal; and (c) means responsive to said error signal for causing said data to be stored in the memory means in a manner which varies with any difference between said first and second signals and for causing the stored data to be transferred to the communication link at a rate within its transmission bandwidth capacity.

Figure 2:
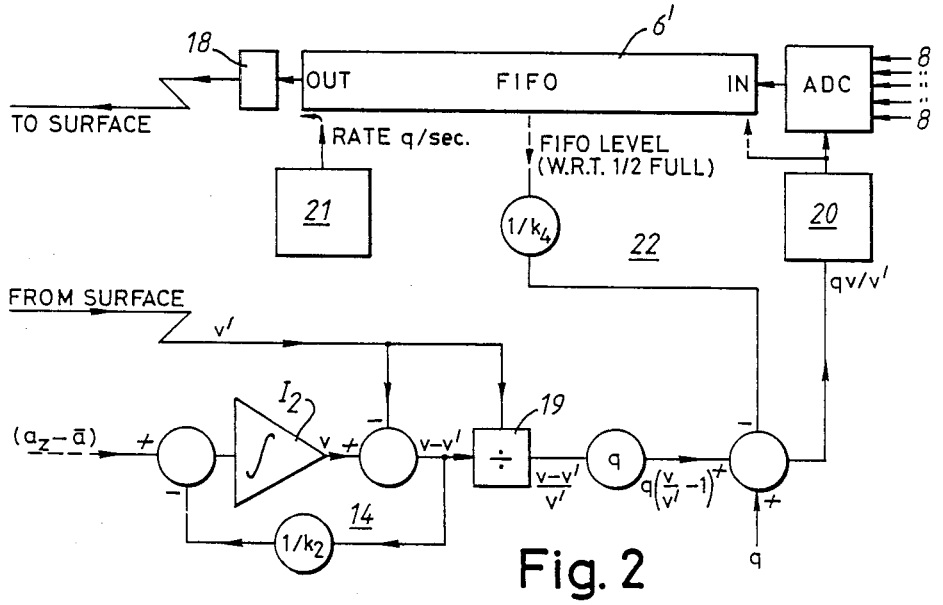
Figure 3:
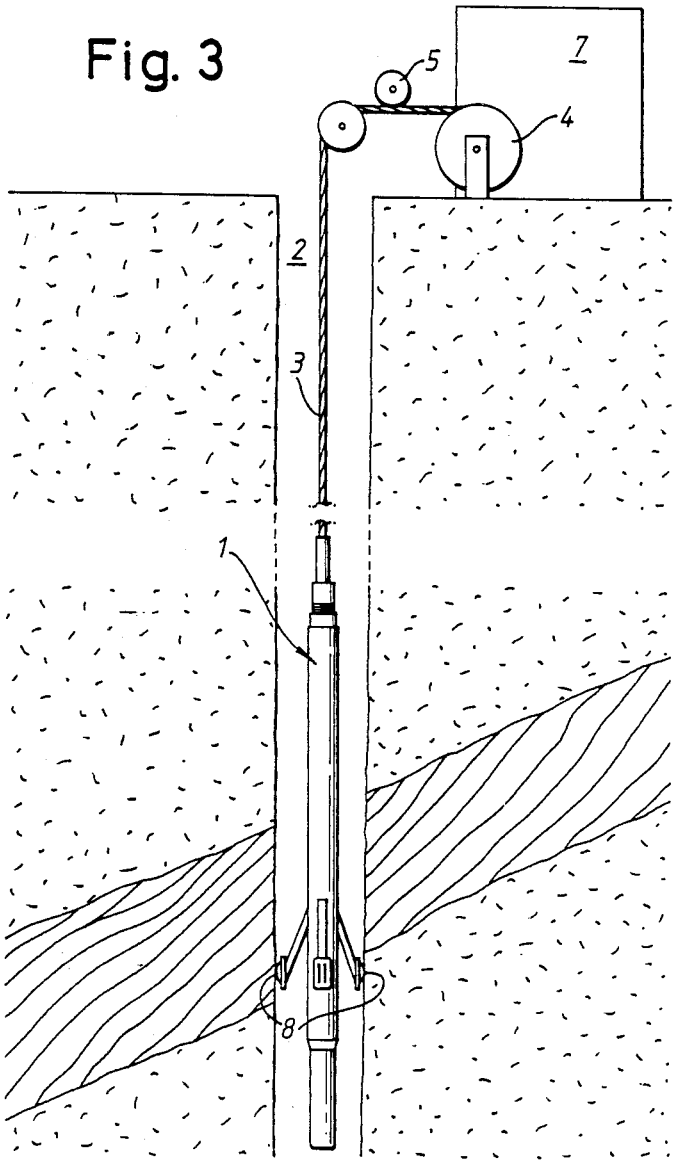

Embodiments of the invention will now be described in more detail with regard to the accompanyng drawings, in which:

FIG. 1 is a schematic diagram of one embodiment of the invention which employs a memory and means for shifting the writing position of data written into the memory, FIG. 2 is a schematic diagram of another embodiment of the invention employing a memory operated in a FIFO mode, and FIG. 3 is a diagram illustrating a logging tool in a borehole.

The system shown in FIGS. 1 and 2 would each be implemented on-board a logging tool 1 as shown in FIG. 3. Apart from these systems and any ancilliary items which are features of the preferred embodiments of the invention, the logging tool may be of known or conventional construction. As such a tool will be familiar to those skilled in the art, no detailed description need be given of its construction and mode of operation. It is important to note that FIGS. 1 and 2 are intended to demonstrate examples of functional algorithms which may be implemented in electronic hardware, or in the software of a downhole microprocessor.

FIG. 3 diagramatically illustrates the tool 1 suspended in a borehole 2 by means of a cable 3 attached to a winch 4. A device 5, of known construction, is responsive to movement of the cable in order to derive a signal relating to the depth of the tool 1 in the borehole 2. The rate of change of this signal is employed, in the preferred embodiments of the invention, to provide a signal v′ representing the apparent velocity of the tool in the borehole. This apparent velocity v′ normally represents the actual velocity v of the tool 1, e.g. as the tool is raised by means of winch 4. However, the apparent and actual velocities of the tool differ in circumstances where the tool sticks in the borehole and the cable 3 subsequently stretches before the tool becomes free and accelerates temporarily towards the surface. This difference is utilised in the preferred embodiments of the invention to control the rate at which data is sampled by sensors 8 and stored in a memory 6 on-board the tool 1. The way in which this data is sampled, stored and transmitted to a surface station is described in more detail below.

The tool 1 is connected to a surface station 7 by means of a communication link in the form of a transmission cable. Cable 3 is typically an armoured multistrand transmission cable (such as a heptacable), in which the armour supports the load of the tool and the multi-stranded core carries the data transmissions. For brevity, cable 3 will be referred to as the transmission cable.

The embodiment of the invention shown in FIG.1 serves schematically to explain algorithms used in the software for controlling a microprocessor (not shown) on-board the tool 1. However, these algorithms could equally well be implemented by hard-wired,digital and-/or analogue circuitry.

In FIG. 1, an accelerometer 10 (of known construction), which is mounted on-board the tool 1, produces a signal $a_z$ relating to tool acceleration, the signal including a gravitational component along the axis of borehole 2, together with an inherent transducer offset. This signal is supplied to a summing point 11 in a feedback loop 12 which incorporates a gain element $1/k_1$ and an integrator $I_1$. The feedback loop 12 removes both the gravitational and offset components of the accelerometer signal leaving a signal $(a_z-a')$ which is proportional to tool acceleration. The latter signal is supplied to an integrator $I_2$ and the output of this integrator is a signal proportional to actual tool velocity v. The latter signal is supplied to a summing point 13 at which the signal v′ (representing the apparent tool velocity) is substracted from the signal v (representing the actual tool velocity). Integrator $I_2$ is part of a feedback loop 14 which incorporates the gain element $1/k_2$, the feedback circuit being designed to maintain the mean value of the difference signal $(v-v')$ at zero so that minor computational or other hardware offsets do not induce significant drift. The difference signal $(v-v')$ is supplied to an integrator $I_3$ in order to produce a tool position error signal x. As shown in FIG. 1, integrator $I_3$ is part of a feedback circuit 15, incorporating a gain element $1/k_3$ which is similarly designed to maintain the mean value of x at zero to avoid drift.

Thus, the integrator $I_3$ produces a time integral of the difference signal $(v-v')$ which is proportional to the difference between the actual position of the tool in the borehole and its apparent position as measured by means 5 at the surface. This time integral or error signal x is then employed to determine the writing position for data to be stored in a memory 6, which data is derived from the sensors 8 on-board the tool 1.

As known in the art, sensors 8 provide outputs which vary in accordance with changes in the properties of ground formations adjacent the borehole 2. Usually, the tool 1 is equipped with different types of sensors (which provide correspondingly different forms of analogue signals), and several sensors of each type (which scan different regions of the ground formations at any given depth). With conventional installations, the data sampling rate is limited by the transmission cable bandwidth and, depending on the application, this may dictate the nominal logging speed. However, as explained above, if a tool sticks adjacent a discontinuity and then accelerates rapidly, after becoming free, valuable data may be lost as a result of not scanning fast enough in the vicinity of interesting formations since the scanning rate is already limited by the bandwidth capacity of the transmission cable. This problem is avoided in the preferred embodiments of the invention as noted below.

In FIG. 1, data from sensors 8 is supplied, in parallel, to analogue-to-digital converter ADC whereby a digital data stream can be written into a memory 6 which serves the microprocessor on-board the logging tool 1. For convenience, the memory 6 has been shown in the form of a shift register having means 16 for selecting the position at which data is written into the memory. The normal position of the writing means 16 is shown as the mid-point of register 6, by way of example, and the rate at which the writing position is moved is controlled by the microprocessor on-board tool 1 with respect to the value of error signal x. However, the apparent velocity signal v′ is used to operate a clock 17 which shifts data out of the memory 6 at a rate (s.v') which is proportional to the signal v'. The clocked-out data is supplied to a telemetry transmitter 18 connected to the transmission cable 3 in order to send data continuously to the surface station. This data may contain a value or block of values relating to the depth of measurement.

If there is no difference between the actual and apparent velocities of the tool (i.e. $v-v'=0$), then the error signal x is zero and the writing position (16) remains in the predetermined mean position. However, where these velocities differ, the error signal x has a value which causes the writing position to move to one side or the other of the mean position as the data is written into the memory 6. The writing position depends on the instantaneous value of the error signal x and care is taken, as x changes, to ensure that the data is written into successive positions so that no memory positions are allowed to retain earlier or null values.

In the case where the actual tool velocity v exceeds the apparent velocity v', writing position (16) moves (to the right of the drawing) in a direction opposite to the normal clocking or shift direction so that more data can be recorded without changing the rate at which the data is clocked out of the memory.

In the case where the actual velocity of the tool is less than its apparent velocity, the error signal x shifts the writing position (16) in the same direction as the normal clocking or shift direction (i.e. to the left of the drawing) so that less data is recorded.

A particular case corresponds to the tool actually stopping, when the write position will be moved at the same rate as the clocked data and the same location will be overwritten, corresponding to the temporary constant depth of the tool.

As will be familiar to those skilled in the art of computer technology, the microprocessor can be programmed to shift the memory writing position to achieve the above objects.

The system of FIG. 1. can be used to log in either direction if the memory 6 is reconfigured as a circular buffer. In this case, an output pointer can be incremented or decremented at a rate proportional to v', and an input pointer (which normally moves at the same rate) can be given an offset which is equal half of the memory length + or − the instantaneous value of the error signal x.

The embodiment of the invention shown by FIG. 2 is similar, in a number of respects, to the embodiment previously described with reference to FIG. 1. For example, it includes accelerometer 10 (not shown) and feedback loops 12,14 (only 14 being shown), telemetry transmitter 18 and a memory 6' which is similar to memory 6, but is operated as a first-in-first-out (FIFO) buffer. In this case, data is removed from the FIFO at a constant rate corresponding to the telemetry capacity. Integrator $I_2$ produces a difference signal, $v-v'$ (as before) which is scaled by a divider 19 to reduce its magnitude in proportion to the apparent or surface measured velocity v'. This value is further scaled by means providing a clock rate q and it is then added to the clock value q to form a new clock value qv/v' which is supplied, as an input clock 20, for controlling data entering the FIFO memory 6'. This data enters via an ADC 20 controlled by clock 20. Output clock 21, having a clock rate q shifts data out of the memory 6' into the telemetry transmitter 18.

A final feedback loop 22 is used to make a slight adjustment to the clock value qv/v' so as to maintain the FIFO half full on average. It can be shown that the FIFO 6' represents a depth offset of n.x.v'/q, where n is the number of memory elements. Care must be taken when implementing this embodiment to avoid practical problems involved in the division process if v' becomes small, i.e. when the winch is stationary or near-stationary.

In either of the above embodiments, it will be understood that where the output of the sensors 8 is a continuously varying quantity, the rate at which these outputs are sampled (to provide instantaneous values) is automatically controlled by the microprocessor on-board the logging tool, i.e. so that each of the memory positions is consequently filled in the required manner.

Whilst FIGS. 1 and 2 schematically illustrate simplified arrangements where parallel analogue data is converted into a single stream of digital data for recording in a memory, more than one ADC channel can be used and more than one memory may be employed to store data in a parallel fashion.

Whilst exemplary embodiments of the invention have been described, it will be understood that modifications and changes can be made within the scope of the invention.

It should be noted that the coefficients $R_1 \ldots R_4$ may, in some implementations, be varied in a continuous manner in order to improve the system's transient response. Kalman's filtering techniques may, for example, be invoked.

Whilst the embodiments of the invention described with reference to FIGS. 1 and 2 indicate a transmission rate which varies with v', this is not strictly necessary, and a practical implementation might transmit continuously at a maximum possible rate, scanning always the latest value to emerge from the store. Thus, for low v' the same value would be transmitted repeatedly. This does not alter the principal concept of the invention. The surface system will only record values which it requires to achieve a log based on regular samples in the apparent depth domain. The same would be true of as simple analogue tool which put a voltage on the cable, to be sampled by an ADC at the surface. As long as the telemetry runs fast enough to cope with the required sampling rate at speed v', then it can be ignored as far as system concepts are concerned.

I claim:

1. A method of processing and transmitting well-logging data wherein a well-logging tool is moved in a borehole in order to collect data relating to ground formations and the data is transmitted to a surface station by means of a communication link, characterised by:

(a) storing said data in said tool as it is moved within the borehole, said data being stored in a manner which varies in accordance with any difference between the actual motion of the tool in the borehole and the apparent motion of the tool as measured at the surface, and (b) transmitting the stored data from said tool to the surface at a rate within the transmission bandwidth capacity of said communication link.

2. A method according to claim 1 in which step (a) is performed by shifting the position at which said data is written into a memory at a rate depending on the difference between the actual and apparent motions of the tool in the borehole.

3. A method according to claim 1, wherein step (a) is performed by clocking the data into a memory operating in a feed-in-feed-out mode, the data being clocked-in at a rate which depends on the difference between the actual and apparent motions of the tool in the borehole.

4. A method according to any one of the preceding claims wherein the data is stored at a rate which is proportional to the difference between the actual and apparent velocities of the tool in the borehole, the actual velocity being derived from a motion sensor on-board the tool and the apparent velocity being inferred from the motion of a cable from which the tool is suspended.

5. Apparatus for processing and transmitting well-logging data, the apparatus comprising a well-logging tool fitted with sensors for collecting data relating to ground formations adjacent a borehole, means for suspending the tool within the borehole and for providing a first signal which relates to the apparent motion of the tool in the borehole, a communication link for transmitting said data to a surface station, and means on-board the tool for providing a second signal which relates to the motion of the tool within the borehole, characterised in that the tool is provided with:

(a) on-board memory means for storing data derived from said sensors;

(b) means responsive to the first and second signals for providing an error signal;

(c) means responsive to said error signal for causing said data to be stored in the memory means in a manner which varies with any difference between said first and second signals and for causing the stored data to be transferred to the communication link at a rate within its transmission bandwidth capacity.

6. Apparatus according to claim 5 wherein means are provided for shifting the writing position of data entered into said memory means, the means for shifting the writing position being responsive to said error signal, and wherein the stored data is transferred to the communication link at a rate determined by said first signal.

7. Apparatus according to claim 5, wherein said memory means is operated in a feed-in-feed-out mode and wherein said means responsive to said error signal is used to derive a clocking signal for controlling the rate at which said data is stored in said memory means, said clocking signal having a variable factor which varies with said difference between said first and second signals and also having a predetermined constant factor, the stored data being transferred to the communication link at a rate related to said constant factor.

8. Apparatus according to any one of claims 5–7, wherein the means on-board the tool for providing the second signal comprises an accelerometer, said means for providing an error signal includes integrating means for integrating the output of the accelerometer in order to provide a signal proportional to the actual velocity of the tool within the borehole, and said first signal is proportional to the apparent velocity of the tool within the borehole; said error signal thereby representing a difference between said actual and apparent velocities of the tool.

* * * * *